US010914502B2

(12) United States Patent
Tomohiko et al.

(10) Patent No.: US 10,914,502 B2
(45) Date of Patent: Feb. 9, 2021

(54) REFRIGERATOR HAVING COMPARTMENTS COOLED TO DIFFERENT INTERNAL TEMPERATURES

(71) Applicant: Samsung Electronics Co., Ltd., Suwon-si (KR)

(72) Inventors: Matsuno Tomohiko, Yokohama (JP); Iwamoto Tomoharu, Yokohama (JP); Shimizu Kazuo, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 163 days.

(21) Appl. No.: 15/830,733

(22) Filed: Dec. 4, 2017

(65) Prior Publication Data

US 2018/0172331 A1 Jun. 21, 2018

(30) Foreign Application Priority Data

Dec. 15, 2016 (JP) ..... 2016-243296
Sep. 21, 2017 (KR) ..... 10-2017-0121639

(51) Int. Cl.
*F25D 17/06* (2006.01)
*F25D 17/04* (2006.01)
(Continued)

(52) U.S. Cl.
CPC ..... *F25D 17/045* (2013.01); *F25B 49/022* (2013.01); *F25D 11/02* (2013.01);
(Continued)

(58) Field of Classification Search
CPC ..... F25D 11/02; F25D 17/045; F25D 17/065; F25D 17/067; F25D 2317/0666; F25B 47/022; F25B 2700/11
See application file for complete search history.

(56) References Cited

U.S. PATENT DOCUMENTS 4,336,692 A * 6/1982 Ecker ..... F24D 11/0221 62/82
5,070,707 A * 12/1991 Ni ..... F25B 41/04 137/629
(Continued)

FOREIGN PATENT DOCUMENTS

JP H07110184 A 4/1995
JP 2005030606 A 2/2005
(Continued)

OTHER PUBLICATIONS

"HVAC Damper." Lennox, www.lennox.com/buyers-guide/guide-to-hvac/glossary/damper. (Year: 2017).*
(Continued)

*Primary Examiner* — Jonathan Bradford

(57) ABSTRACT

A first storage compartment's influence on a second storage compartment, when the first storage compartment and the second storage compartment have different temperature ranges and are cooled by a single cooler, is reduced. A refrigerator includes a compressor for compressing and circulating a refrigerant, a cooler provided to generate cold air through circulation of the refrigerant, a first storage compartment having an temperature maintained within a first range, a second storage compartment having an temperature maintained within a second range different from the first range, a first air passage for guiding cold air generated in the cooler to the first storage compartment, a second air passage for guiding cold air generated in the cooler to the second storage compartment, and a switching unit for guiding the cold air generated in the cooler to selectively flow into any one of the first air passage and the second air passage.

18 Claims, 17 Drawing Sheets

(51) Int. Cl.

| | |
|---|---|
| ***F25B 49/02*** | (2006.01) |
| ***F25D 11/02*** | (2006.01) |
| ***F25D 21/00*** | (2006.01) |
| ***F25D 29/00*** | (2006.01) |
| *F25B 47/02* | (2006.01) |

(52) U.S. Cl.
CPC ..... *F25D 17/065* (2013.01); *F25D 21/004* (2013.01); *F25D 21/006* (2013.01); *F25D 29/003* (2013.01); *F25B 47/022* (2013.01); *F25B 2700/2117* (2013.01); *F25D 2317/061* (2013.01); *F25D 2317/067* (2013.01); *F25D 2317/0666* (2013.01); *F25D 2400/06* (2013.01); *F25D 2700/12* (2013.01); *F25D 2700/121* (2013.01)

(56) References Cited

U.S. PATENT DOCUMENTS

| | | | | | |
|---|---|---|---|---|---|
| 5,375,428 | A * | 12/1994 | LeClear | F25B 40/00 | 62/187 |
| 5,675,983 | A * | 10/1997 | Ibrahim | A47F 3/0408 | 62/255 |
| 5,809,790 | A | 9/1998 | Kwon | | |
| 5,881,568 | A * | 3/1999 | Kim | F25D 17/065 | 62/443 |
| 5,904,049 | A * | 5/1999 | Jaster | F25B 41/062 | 62/204 |
| 5,992,165 | A * | 11/1999 | Kim | F25D 17/045 | 62/187 |
| 6,000,095 | A * | 12/1999 | Johnson | B60S 3/002 | 15/312.1 |
| 6,330,803 | B1 * | 12/2001 | Shin | F25D 17/065 | 62/156 |
| 2005/0126207 | A1 | 6/2005 | Lee et al. | | |
| 2006/0144063 | A1 | 7/2006 | Oh | | |
| 2010/0107678 | A1 | 5/2010 | Kim et al. | | |
| 2013/0042641 | A1 | 2/2013 | Ryu et al. | | |
| 2013/0086928 | A1 | 4/2013 | Cho et al. | | |

FOREIGN PATENT DOCUMENTS

| | | | |
|---|---|---|---|
| JP | 2008039296 | | 2/2008 |
| KR | 100657556 | B1 | 12/2006 |
| WO | 2008120907 | A2 | 10/2008 |

OTHER PUBLICATIONS

"A Stuck Damper Between the Refrigerator & Freezer." Hunker, Hunker.com, Jul. 17, 2017, www.hunker.com/13409759/a-stuck-damper-between-the-refrigerator-freezer. (Year: 2017).*

Foreign Communication from Related Counterpart Application; PCT Patent Application No. PCT/KR20171013700; International Search Report dated Mar. 14, 2018; 3 pages.

Supplementary European Search Report dated Oct. 15, 2019 in connection with European Patent Application No. 17 88 1965, 8 pages.

Office Action dated Aug. 5, 2020 in connection with Chinese Patent Application No. 201780085972.7, 22 pages.

* cited by examiner

REFRIGERATOR HAVING COMPARTMENTS COOLED TO DIFFERENT INTERNAL TEMPERATURES

CROSS-REFERENCE TO RELATED APPLICATION AND CLAIM OF PRIORITY

This application is related to and claims priority to Japanese Patent Application No. 2016-243296, filed on Dec. 15, 2016 and Korean Patent Application No. 10-2017-0121639, filed on Sep. 21, 2017, the contents of which are incorporated herein by reference.

TECHNICAL FIELD

Embodiments of the present disclosure relate to a refrigerator, and more specifically, to a refrigerator including a cooler.

BACKGROUND

There is a refrigerator known to have a structure in which cold air generated in a cooler is blown by the blowing power of a fan into a space formed by a cooler front plate and a freezing compartment back plate, discharged from a hole provided in the freezing compartment back plate to each portion of the freezing compartment, and blown into a temperature adjustment device through a cold air passage. The amount of cold air blown into the refrigerator is controlled by the temperature adjustment device, a controlled amount of cold air is guided to a duct for distributing cold air, and cold air is divided into proper amounts in the duct for distribution and guided directly from a discharge port to a rear part of each portion of the refrigerating compartment (e.g., refer to Patent literature 1).

There is also a refrigerator known to have a structure in which a cold air passage extending in the vertical direction of the refrigerator is provided at the rear of a refrigerating compartment and freezing compartment. An evaporator which is a cooler, a freezing compartment blower, and a refrigerating compartment blower are disposed inside the cold air passage. In an upstream side of a cold air flow direction of the freezing compartment blower, air is cooled while passing through the evaporator to become cold air. Cold air passing through the cold air passage is discharged from the downstream side of the freezing compartment blower through a discharge port to the freezing compartment, and is discharged from the downstream side of the refrigerating compartment blower through a discharge port to the refrigerating compartment (e.g., refer to Patent literature 2).

[Patent literature 1] Japanese Patent Laid-Open Publication No. H4-36576

[Patent literature 2] Japanese Patent Laid-Open Publication No. 2016-50678

SUMMARY

To address the above-discussed deficiencies, it is a primary object to provide that when a first storage compartment and a second storage compartment with different temperature ranges are cooled by a single cooler, in a structure wherein only the first storage compartment is cooled upon cooling of the first storage compartment and wherein the first storage compartment and the second storage compartment are cooled upon cooling of the second storage compartment, the environment of the first storage compartment may influence the second storage compartment because cold air of the first storage compartment flows into the second storage compartment during cooling of the second storage compartment.

An objective of the present disclosure is to reduce the possibility that the environment of the first storage compartment influences the second storage compartment when the first storage compartment and the second storage compartment have different temperature ranges and are cooled by a single cooler.

Therefore, it is an aspect of the present disclosure to provide a refrigerator that includes a compressor for compressing and circulating a refrigerant, a cooler provided to generate cold air through circulation of the refrigerant by the compressor, a first storage compartment having an internal temperature maintained within a first temperature range, a second storage compartment having an internal temperature maintained within a second temperature range different from the first temperature range, a first cold air passage for guiding cold air generated in the cooler to the first storage compartment, a second cold air passage for guiding cold air generated in the cooler to the second storage compartment, and a switching unit for guiding the cold air generated in the cooler to selectively flow into any one of the first cold air passage and the second cold air passage.

Here, the first cold air passage and the second cold air passage may share at least one side wall.

Further, the second cold air passage may be disposed at a position farther from the first storage compartment than the first cold air passage.

Further, the first temperature range may be lower than the second temperature range.

In this case, the refrigerator may further include an auxiliary switching unit which prevents cold air from flowing from the cooler room accommodating the cooler to the second storage compartment when cold air generated in the cooler is guided to the first cold air passage by the switching unit, and which guides cold air to flow from the second storage compartment to the cooler room when cold air generated in the cooler is guided to the second cold air passage by the switching unit.

Further, in this case, the refrigerator may further include a cooling fan for blowing cold air generated in the cooler, and the switching unit may guide cold air blown by the cooling fan to selectively flow into any one of the first cold air passage and the second cold air passage.

Further, the refrigerator may further include a processor which controls the switching unit such that cold air blown by the cooling fan flows into the first cold air passage, stops the compressor, operates the cooling fan, and then controls the switching unit such that cold air blown by the cooling fan flows into the second cold air passage.

In this case, the processor may control the switching unit such that cold air blown by the cooling fan flows into the second cold air passage when a temperature of the cooler reaches a predetermined temperature or a predetermined amount of time has elapsed.

In this case, the processor may control the switching unit such that cold air blown by the cooling fan flows into the second cold air passage, and then may operate the compressor again when a temperature inside the second storage compartment or a temperature of the cooler is equal to or higher than a predetermined temperature, or when an amount of time used for cooling the second storage compartment exceeds a predetermined amount of time.

Furthermore, the refrigerator further includes expansion valves having two or more different diameters, and the processor may change a flow rate of the refrigerant by switching to a diameter of any one of the two or more different diameters when the compressor is operated.

Further, in this case, the processor may control the switching unit such that cold air blown by the cooling fan flows into the second cold air passage, and then may stop the cooling fan when a temperature inside the second storage compartment or a temperature of the cooler is equal to or higher than a predetermined temperature, or when an amount of time used for cooling the second storage compartment exceeds a predetermined amount of time.

Furthermore, the processor may stop the cooling fan and restart the cooling fan when a temperature of the cooler reaches a predetermined temperature or when a predetermined amount time has elapsed.

Further, in this case, the processor may continue to operate the cooling fan even when a temperature inside the second storage compartment reaches a target temperature.

Furthermore, the processor may open a bypass path for directly guiding the refrigerant with high temperature compressed by the compressor to the cooler when the cooling fan is operated.

Furthermore, the processor may close a bypass path when a temperature inside the second storage compartment or a temperature of the cooler reaches a predetermined temperature.

Further, the refrigerator may include a processor for operating the cooling fan during a defrosting operation of the cooler, and controlling the switching unit such that cold air blown by the cooling fan flows into the second cold air passage.

In this case, the processor may stop the cooling fan when a temperature inside the second storage compartment or a temperature of the cooler reaches a predetermined temperature or when a predetermined amount of time has elapsed.

Further, the switching unit may include a first opening communicating with the first cold air passage, a second opening communicating with the second cold air passage, and at least one opening and closing plate for selectively opening and closing any one of the first opening and the second opening.

Here, the at least one opening and closing plate may include a first opening and closing plate for opening and closing the first opening, and a second opening and closing plate for opening and closing the second opening.

Further, the switching unit may further include a driving unit for driving the first opening and closing plate and the second opening and closing plate.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 10B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

According to an embodiment of the present disclosure, in a refrigerator in which a first storage compartment and a second storage compartment with different temperature ranges are cooled by a single cooler, the environment of the first storage compartment influencing the second storage compartment through cold air of the first storage compartment flowing into the second storage compartment is prevented. For example, when the first storage compartment is a freezing compartment and the second storage compartment is a refrigerating compartment, the humidity in the refrigerating compartment is prevented from decreasing by cold air of the freezing compartment flowing into the refrigerating compartment, and the humidity of the refrigerating compartment is maintained, at low cost, to be equal to or higher than the humidity in the refrigerating compartment of a refrigerator having two or more coolers at.

Specifically, the refrigerator has a duct structure for achieving cooling at an evaporation temperature suitable for each of the freezing compartment and refrigerating compartment. That is, a cold air passage for cooling only a freezing compartment and a cold air passage for cooling only a refrigerating compartment are separately provided in a single duct, and switching between these cold air passages for cooling is controlled by a single damper provided in the duct. Further, a cooling fan and a damper are controlled to optimize switching between cooling the freezing compartment and cooling the refrigerating compartment.

Further, the evaporation temperature is controlled by an expansion valve and a capillary tube. That is, humidity in the refrigerating compartment is controlled by optimizing the evaporation temperature during cooling the refrigerating compartment.

First Embodiment

Figure 1:
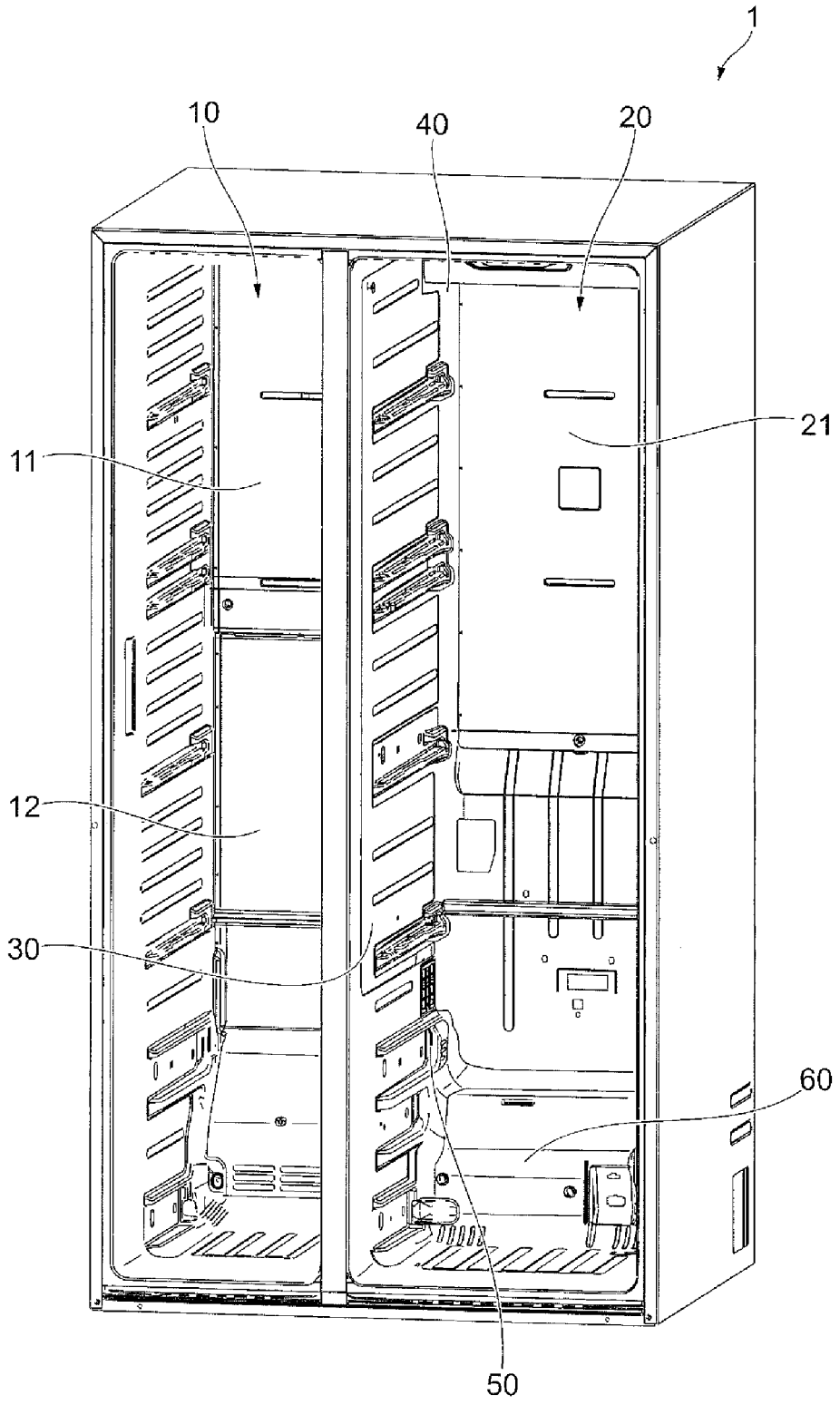
FIG. 1 is an overall view of a refrigerator according to a first embodiment of the present disclosure.

FIG. 1 is an overall view of a refrigerator 1 according to a first embodiment of the present disclosure. As shown in the drawing, the refrigerator 1 includes a freezing compartment 10 as an example of a first storage compartment and a refrigerating compartment 20 as an example of a second storage compartment. Further, a partition 30, an upper cold air passage 40, a lower cold air passage 50, and a compressor 60 are provided.

FIG. 1 is a view of the refrigerator 1 viewed from a front side, a freezing compartment duct cover 11 and a cooler cover 12 are shown in the freezing compartment 10, and a refrigerating compartment duct cover 21 is shown in the refrigerating compartment 20.

The partition 30 separates the freezing compartment 10 and the refrigerating compartment 20. The upper cold air passage 40 is a cold air passage provided on the upper portion of the partition 30 and the lower cold air passage 50 is a cold air passage provided on the lower portion of the partition 30, which will be described in detail below. The compressor 60 compresses a refrigerant and circulates the refrigerant in a refrigeration cycle.

Figure 2:
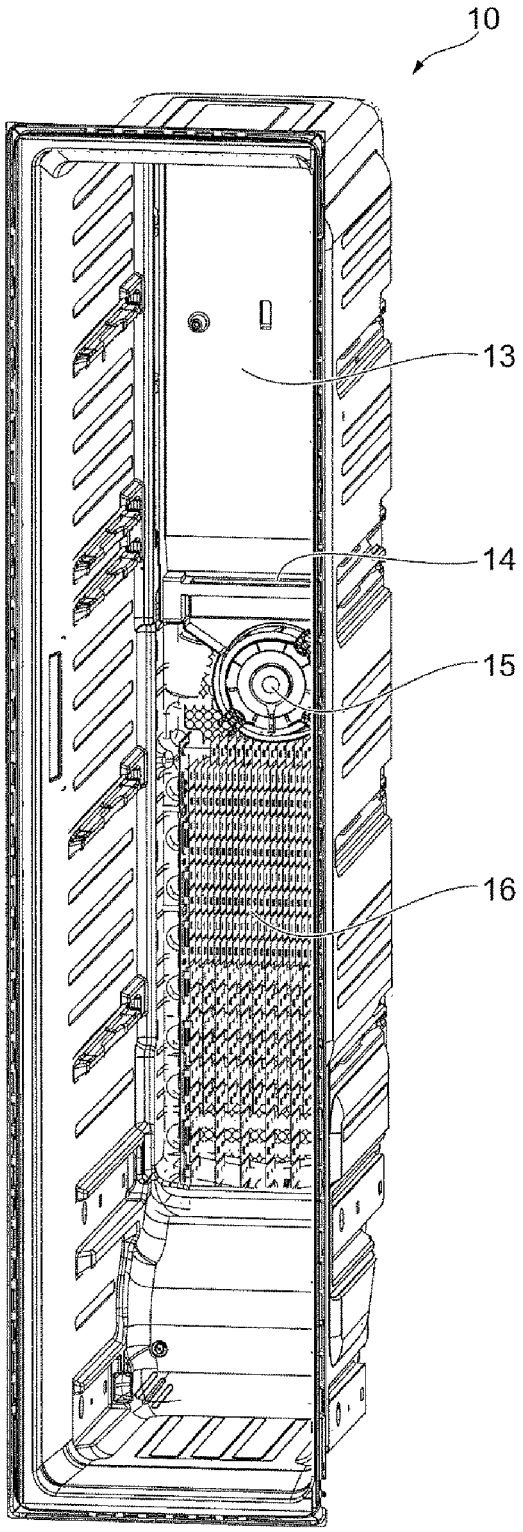
FIG. 2 is an overall view of a freezing compartment according to the first embodiment of the present disclosure from which a freezing compartment duct cover and a cooler cover have been removed.

FIG. 2 is an overall view of the freezing compartment 10 according to the first embodiment of the present disclosure from which the freezing compartment duct cover 11 and the cooler cover 12 have been removed. As shown in the drawing, the freezing compartment 10 includes a freezing compartment duct wall 13, a damper 14, a cooling fan 15, and a cooler 16.

The freezing compartment duct wall 13 is a wall installed in the freezing compartment duct. The damper 14 is an example of a switching means, is provided in the freezing compartment duct, and switches the flow path of cold air blown by the cooling fan 15, the details of which will be described below. The cooling fan 15 is a fan for blowing cold air generated by the cooler 16 into the refrigerator 1. The cooler 16 generates cold air for cooling the inside of the refrigerator 1 by evaporating the refrigerant.

Further, although not shown, when the refrigerating compartment duct cover 21 of FIG. 1 is removed, there is a refrigerating compartment duct. On the other hand, there is no cooler in the refrigerating compartment 20. That is, the refrigerator 1 shown in FIG. 1 cools the freezing compartment 10 and the refrigerating compartment 20 with a single cooler 16.

Figure 3A:
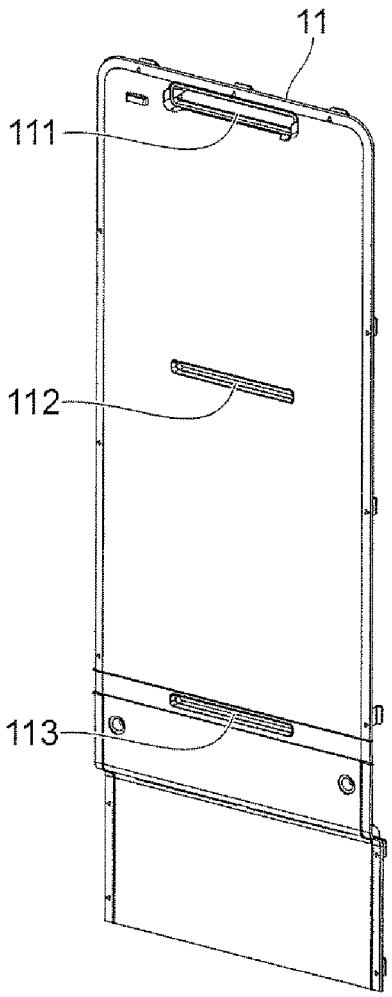
FIGS. 3A, 3B, and 3C are views showing a structure of a freezing compartment duct according to the first embodiment of the present disclosure.
Figure 3B:
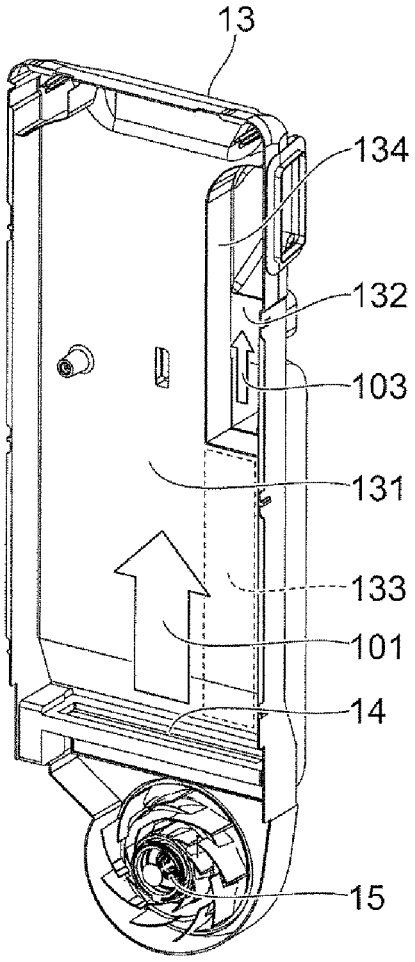
Figure 3C:
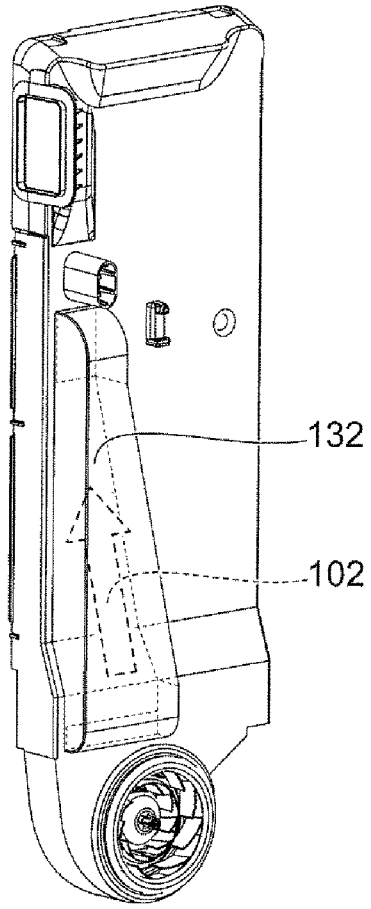

FIGS. 3A to 3C are views illustrating a structure of the freezing compartment duct in the first embodiment of the present disclosure.

FIG. 3A shows the freezing compartment duct cover 11. As shown in the drawing, openings 111, 112, and 113 are installed in the freezing compartment duct cover 11. Further, although three openings 111, 112 and 113 are installed here, the number of openings is not limited thereto.

FIG. 3B is a view of the freezing compartment duct wall 13 viewed from the front, and FIG. 3C is a view of the freezing compartment duct wall 13 viewed from the side. As shown by arrow 101 in FIG. 3B, a passage for cooling a freezing compartment 131 is formed on the front surface of the freezing compartment duct wall 13 as an example of a first cooling air passage used for cooling the freezing compartment 10.

Further, as shown by arrows 102 in FIG. 3C and 103 in FIG. 3B, a passage for cooling a refrigerating compartment 132 is formed on the rear surface of the freezing compartment duct wall 13 as an example of a second cold air passage used for cooling the refrigerating compartment 20. Here, the passage for cooling a freezing compartment 131 and passage for cooling a refrigerating compartment 132, which are passages of two systems, form a single passage together.

Further, one side wall forming the passage for cooling a freezing compartment 131 and one side wall forming the passage for cooling a refrigerating compartment 132 are provided as a shared side wall 133.

Further, the passage for cooling a freezing compartment 131 and passage for cooling a refrigerating compartment 132 are individually formed by the partition 134.

Further, the freezing compartment duct wall 13 is provided with the damper 14 for switching between the passage for cooling a freezing compartment 131 and passage for cooling a refrigerating compartment 132, and with the cooling fan 15 for blowing cold air.

With this passage structure, a reduction in space can be achieved in comparison to a case where the passages of two systems are completely separated. Further, since the side wall is shared, leakage of cold air can be suppressed and material costs can be reduced.

Further, as described above, the passage for cooling a refrigerating compartment 132 is installed outside the passage for cooling a freezing compartment 131 (the side opposite to the freezing compartment duct cover 11). That is, the passage for cooling a freezing compartment 131 is provided near the freezing compartment 10, and the passage for cooling a refrigerating compartment 132 is provided on the side farther from the freezing compartment 10.

Figure 4A:
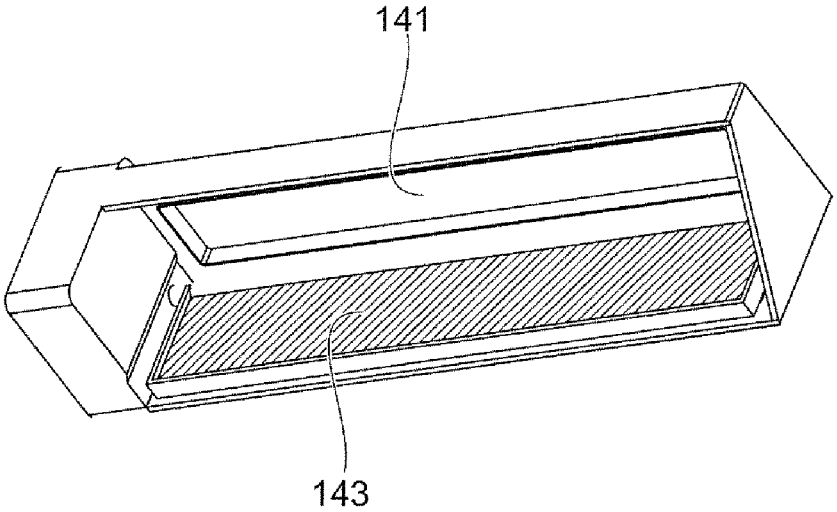
FIGS. 4A and 4B are views showing a structure of a damper used in the first embodiment of the present disclosure.
Figure 4B:
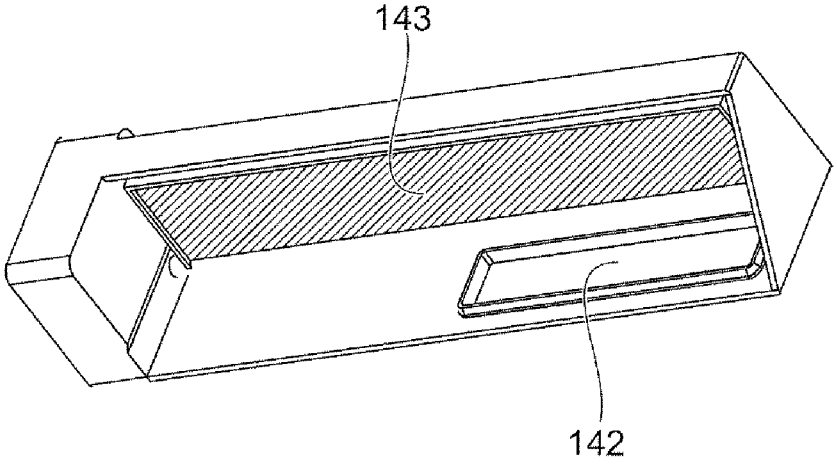

FIGS. 4A and 4B are views illustrating a structure of the damper 14. As shown in the drawing, the damper 14 includes an opening for a passage for cooling a freezing compartment 141 in the direction toward the passage for cooling a freezing compartment 131, an opening for a passage for cooling a refrigerating compartment 142 in the direction toward the passage for cooling a refrigerating compartment 132, and an opening and closing plate 143.

For example, as shown in FIG. 4A, when the opening and closing plate 143 is oriented in the vertical direction, the opening for a passage for cooling a freezing compartment 141 is open and the opening for a passage for cooling a refrigerating compartment 142 is closed. Further, as shown in FIG. 4B, when the opening and closing plate 143 is oriented in the horizontal direction, the opening for a passage for cooling a freezing compartment 141 is closed and the opening for a passage for cooling a refrigerating compartment 142 is open.

Although not shown, cold air may be blown to both the passage for cooling a freezing compartment 131 and passage for cooling a refrigerating compartment 132 by allowing any one of the opening for a passage for cooling a freezing compartment 141 and the opening for passage for cooling a refrigerating compartment 142 to be half-open.

Next, a description will be given of the flow of cold air during cooling the freezing compartment 10 and during cooling the refrigerating compartment 20.

Figure 5A:
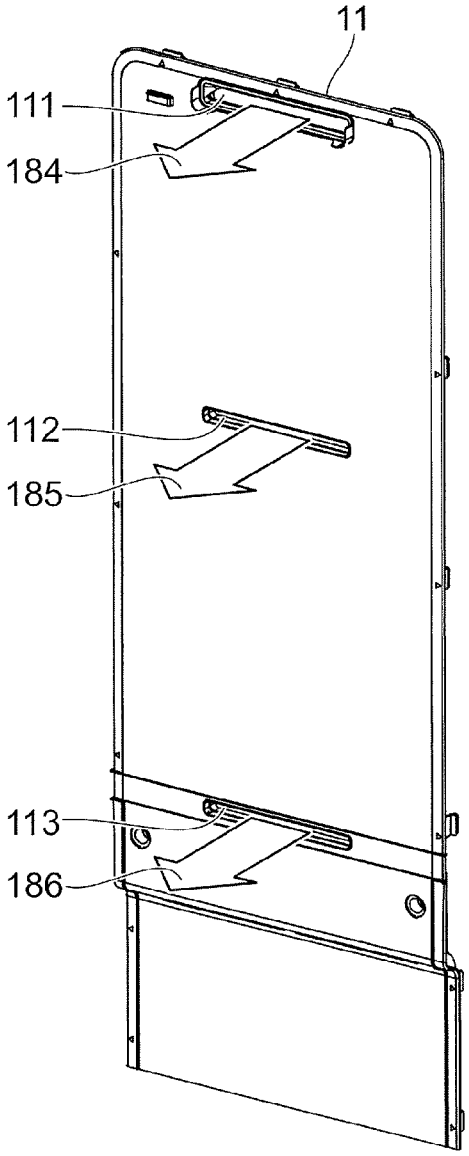
FIGS. 5A and 5B are views showing a flow of cold air during cooling the freezing compartment in the first embodiment of the present disclosure.
Figure 5B:
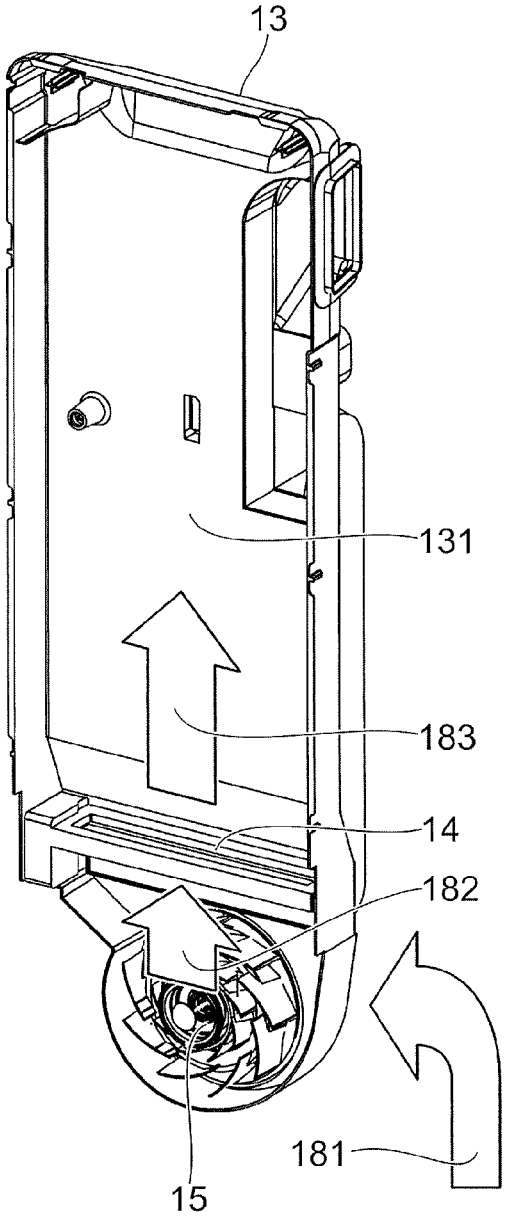

FIGS. 5A and 5B show the flow of cold air during cooling the freezing compartment 10.

In FIG. 5B, cold air that has passed through the cooler 16 is intaken by the cooling fan 15 from a fan suction port on the rear surface of the freezing compartment duct wall 13, as shown by arrow 181, and is discharged in a direction toward the damper 14, as shown by arrow 182.

In FIG. 5B, since the damper 14 has the opening for a passage for cooling a freezing compartment 141 completely open (the opening for a passage for cooling a refrigerating compartment 142 is completely closed), cold air passes through only the passage for cooling a freezing compartment 131, as indicated by arrow 183.

Thereafter, in FIG. 5A, as shown by arrows 184, 185, and 186, cold air is discharged from the openings 111, 112, and 113 formed in the freezing compartment duct cover 11 into only the freezing compartment 10, such that only the freezing compartment 10 is cooled. That is, cold air is not discharged into the refrigerating compartment 20.

Further, since one side wall of the passage for cooling a freezing compartment 131 and one side wall of the passage for cooling a refrigerating compartment 132 are provided as the shared side wall 133 (see FIG. 3B), air temperature can be lowered by heat transfer into the passage for cooling a refrigerating compartment 132 through the shared side wall 133 during cooling the freezing compartment 10, a cooling rate when the refrigerating compartment 20 is cooled can be increased, and in addition, energy can be saved.

Figure 6A:
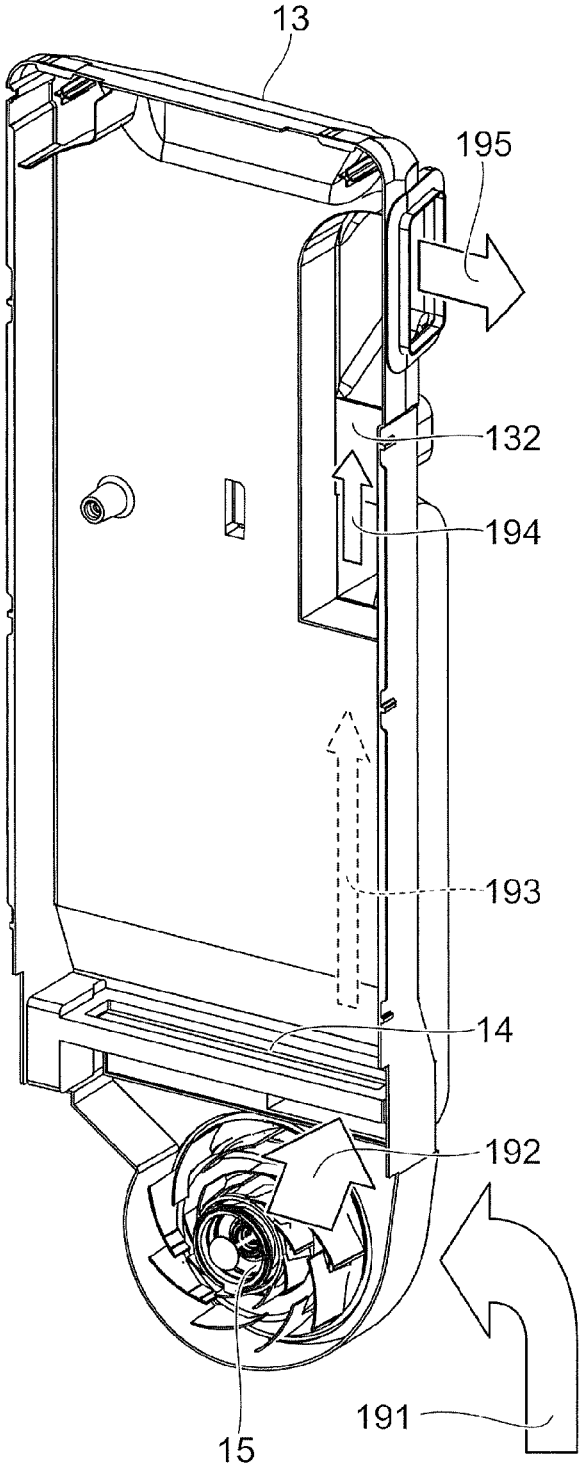
FIGS. 6A and 6B are views showing a flow of cold air during cooling the refrigerating compartment in the first embodiment of the present disclosure.
Figure 6B:
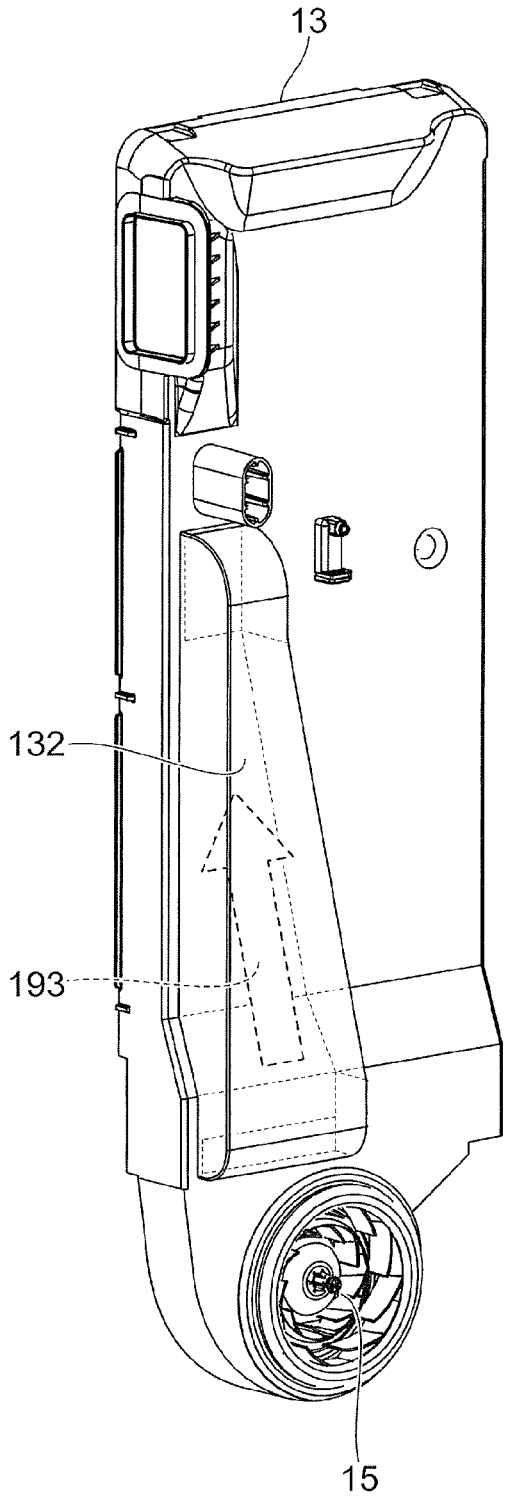

FIGS. 6A and 6B show the flow of cold air during cooling the refrigerating compartment 20.

In FIG. 6A, cold air that has passed through the cooler 16 is intaken by the cooling fan 15 from a fan suction port on the rear surface of the freezing compartment duct cover 11, as shown by arrow 191, and is discharged in the direction of the damper 14, as shown by arrow 192.

In FIGS. 6A and 6B, since the damper 14 has the opening for a passage for cooling a refrigerating compartment 142 completely open (the opening for a passage for cooling a freezing compartment 141 is completely closed), cold air passes through only the passage for cooling a refrigerating compartment 132, as indicated by arrows 193 and 194.

Thereafter, in FIG. 6A as shown by arrow 195, cold air is guided to the refrigerating compartment duct via the upper cold air passage 40 and discharged from several openings provided in the refrigerating compartment duct cover 21 into only the refrigerating compartment 20, such that only the refrigerating compartment 20 is cooled. That is, cold air is not discharged into the freezing compartment 10.

During cooling the refrigerating compartment 20, there is no inflow of cold air in a cooling temperature range of the freezing compartment 10, which is relatively low in temperature and low in humidity compared to the refrigerating compartment 20, and thus humidity in the refrigerating compartment 20 can be prevented from decreasing.

Further, since the passage for cooling a refrigerating compartment 132 is installed outside the passage for cooling a freezing compartment 131 (the side opposite to the freezing compartment duct cover 11), it is possible to prevent cold air in a temperature range higher than a cooling temperature of the freezing compartment 10, which passes through the passage for cooling a refrigerating compartment 132 during cooling the refrigerating compartment 20, from being directly transmitted to the freezing compartment duct cover 11, and thus an increase in temperature in the freezing compartment 10 can be suppressed, and energy can be saved.

Referring to FIG. 1, the upper cold air passage 40 and lower cold air passage 50 will be described.

As described above, the upper cold air passage 40 is used as a passage for guiding cold air passed through the cooler 16 to the refrigerating compartment duct.

On the other hand, the lower cold air passage 50 is a passage used as a return passage for returning cold air used for cooling in the refrigerating compartment 20 to the cooler 16 installed in the freezing compartment 10.

A damper (not shown) is provided in the lower cold air passage 50 as an example of a second switching means, and the damper is opened during cooling the refrigerating compartment 20 to form a return passage. On the other hand, during cooling the freezing compartment 10, the damper is closed to prevent cold air from flowing between the freezing compartment 10 and the refrigerating compartment 20, and to prevent cold air having low temperature and low humidity in the freezing compartment 10 from flowing into the refrigerating compartment 20, and thereby a decrease in humidity in the refrigerating compartment 20 can be suppressed.

The refrigerator 1 further includes the damper 14, the cooling fan 15, the compressor 60, and a processor (not shown) for controlling opening and closing of the valves.

Hereinafter, an operation for controlling humidity so that the inside of the refrigerating compartment 20 has high humidity will be described.

Figure 7:
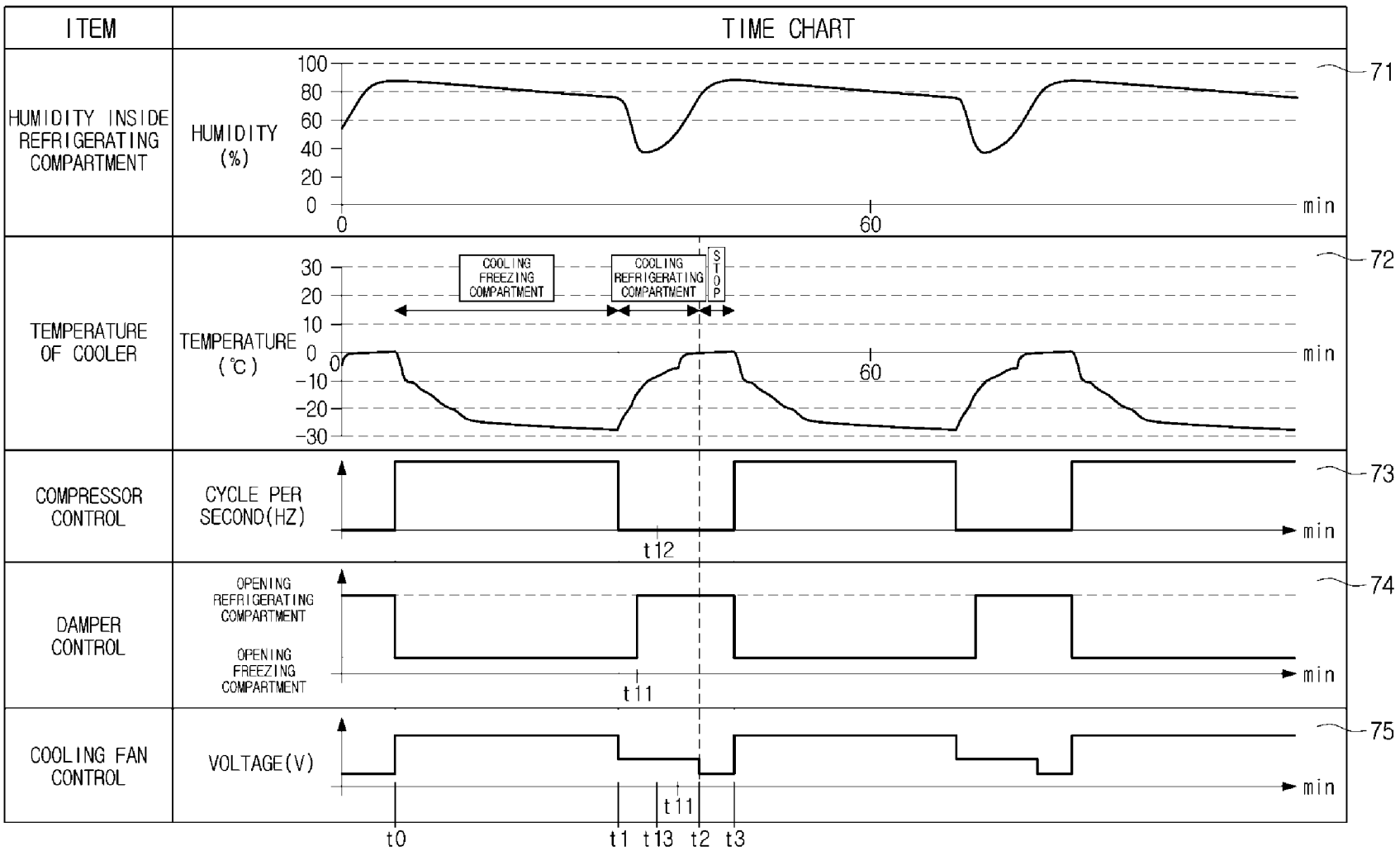
FIG. 7 is a time graph of an operation in the first embodiment of the present disclosure for controlling humidity so that the interior of the refrigerating compartment has high humidity.

FIG. 7 is a time graph of the above-described operation.

As shown in the time chart 71 and time chart 72, since humidity in the refrigerating compartment 20 is lowered when cooling the refrigerating compartment 20 is cooled, that is, when the damper 14 allows the opening for a passage for cooling a refrigerating compartment 142 to be open toward the refrigerating compartment 20 side, a decrease in humidity needs to be suppressed when the refrigerating compartment 20 is cooled.

The decrease in humidity when the refrigerating compartment 20 is cooled is mainly caused by dehumidification due to a low temperature of the cooler 16, and thus the temperature of the cooler 16 needs to be raised when the refrigerating compartment 20 is cooled.

The time t1 of the time graph 73, the time t11 of the time graph 74, and the time t1 of the time graph 75 indicate a humidity control operation when the cooling of the refrigerating compartment 20 starts. That is, before a flow path is switched at the time t11 by the damper 14 shown in FIGS. 4A and 4B, the compressor 60 is stopped and the cooling fan 15 is operated at the time t1, and thereby a temperature of the cooler 16 is raised in advance before cold air is sent into the refrigerating compartment 20. Here, the time t11 may be determined by the temperature of the cooler 16 or may be determined by the amount of elapsed time after the compressor 60 stops. For example, when it is determined that the temperature of the cooler 16 has become equal to or higher than the predetermined temperature, or when it is determined that the predetermined amount of time has elapsed since the compressor 60 stopped, cooling is started by the damper 14 allowing cold air to be sent into the refrigerating compartment 20.

During cooling the refrigerating compartment 20, the air inside the refrigerating compartment 20 circulates, and thus the temperature of the cooler 16 rises and the temperature inside the refrigerating compartment 20 may reach a temperature at which the refrigerating compartment 20 cannot be cooled. Accordingly, when the temperature inside the refrigerating compartment 20 or the temperature of the cooler 16 becomes equal to or higher than the predetermined temperature, that is, when a decreasing gradient of the temperature in the refrigerating compartment 20 becomes equal to or less than a predetermined gradient, the compressor 60 is restarted to prevent uncooling. Alternatively, when an amount of time required used for cooling the inside of the refrigerating compartment 20 is a predetermined amount of time or more, the compressor 60 may be restarted to prevent uncooling. In the time graph 73, the restart time of the compressor 60 is indicated by the time t12.

Further, in the same case, the cooling fan 15 may be stopped to prevent uncooling. In the time graph 75, the stop time of the cooling fan 15 is indicated by the time t13. Furthermore, in this case, the cooling fan 15 is operated again to raise the temperature of the cooler 16 at the time t14. Here, the time t14 may be determined by the temperature of the cooler 16 or may be determined by the amount of elapsed time after the cooling fan 15 stops. For example, when it is determined that the temperature of the cooler 16 has become equal to or higher than the predetermined temperature, or when it is determined that the predetermined time has elapsed since of the cooling fan 15 stopped, the cooling fan 15 is operated again.

Thereafter, when the temperature in the refrigerating compartment 20 reaches a target temperature at the time t2, cooling of the refrigerating compartment 20 is terminated and a refrigeration mode is changed to a stop mode. In this stop mode, the cooling fan 15 is continuously operated to raise the temperature of the cooler 16, as shown in the time graph 75. Accordingly, the temperature of the cooler 16 can be higher than 0° C., humidity in the refrigerating compartment 20 can be raised, and frost on the cooler 16 can be removed.

Further, although not shown in the time graph of FIG. 7, the refrigerator 1 periodically performs a defrosting operation for removing frost on the cooler 16, and thus the damper 14 may be opened toward the refrigerating compartment 20 and the cooling fan 15 may be operated during the defrosting operation. Accordingly, moisture generated by defrosting can be sent to the inside of the refrigerating compartment 20 and humidity inside the refrigerating compartment 20 can be raised by a process other than the cycle shown in FIG. 7.

Further, when a value of a temperature sensor for detecting the temperature of the cooler 16 or the refrigerating compartment 20 reaches a predetermined value, or when a predetermined amount time has elapsed since the operation of the cooling fan 15 started, the temperature in the refrigerating compartment 20 can be prevented from exceeding the predetermined temperature by stopping the cooling fan 15.

Figure 8:
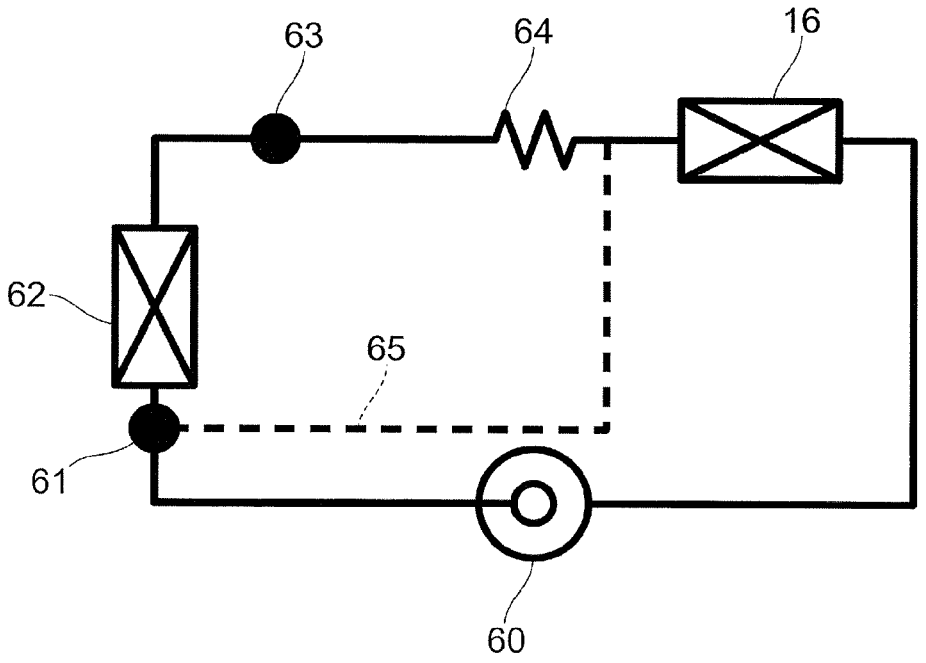
FIG. 8 is a view showing a cooling cycle suitable for use in an operation in the first embodiment of the present disclosure for controlling humidity so that the interior of the refrigerating compartment has high humidity.

FIG. 8 is a view showing a cooling cycle suitable for use in an operation for controlling so humidity so that the interior of the refrigerating compartment 20 has high humidity. As shown in the drawing, this cooling cycle is formed by connecting the cooler 16, a compressor 60, a three-way switching valve 61, a condenser 62, a variable expansion valve 63, a capillary tube 64, and the like using a pipe. Further, this cooling cycle also includes a bypass path 65.

That is, in this cooling cycle, an expansion mechanism having two or more different diameters is achieved by a variable expansion valve 63. As described above, when the compressor 60 is restarted during cooling the refrigerating compartment 20, the temperature of the cooler 16 is lowered, which causes a decrease in humidity in the refrigerating compartment 20. Therefore, a flow rate of the refrigerant is changed by the variable expansion valve 63 only when the refrigerating compartment 20 is cooled, such that cooling is performed while the cooler 16 is maintained at a high temperature, thereby suppressing a decrease in humidity in the refrigerating compartment 20.

Further, in this cooling cycle, as described above, a bypass path 65 is provided for directly sending a high temperature refrigerant compressed by the compressor 60 to the cooler 16. Here, switching the flow path of the refrigerant to the bypass path 65 is performed by the three-way switching valve 61. When cooling of the freezing compartment 10 and the refrigerating compartment 20 is completed, a high temperature refrigerant flows to the bypass path 65 through the three-way switching valve 61 and the cooling fan 15 is operated, and thereby the temperature of the cooler 16 can be higher than 0° C., the humidity in the refrigerating compartment 20 can be increased, and frost on the cooler 16 can be removed.

Further, when a temperature value of a temperature sensor for detecting the temperature of the cooler 16 or the refrigerating compartment 20 reaches a predetermined value, the bypass path 65 is closed to prevent the temperature in the refrigerating compartment 20 from being equal to or higher than the predetermined temperature.

According to the present embodiment, in a refrigerator in which a first storage compartment and a second storage compartment with different temperature ranges are cooled by one cooler, the environment of the first storage compartment is prevented, at low cost, from influencing the second storage compartment.

Second Embodiment

The refrigerator 1 according to the second embodiment of the present disclosure is the same as that described in the first embodiment except for the inside of the freezing compartment duct, and thus a description thereof will be omitted.

Figure 9A:
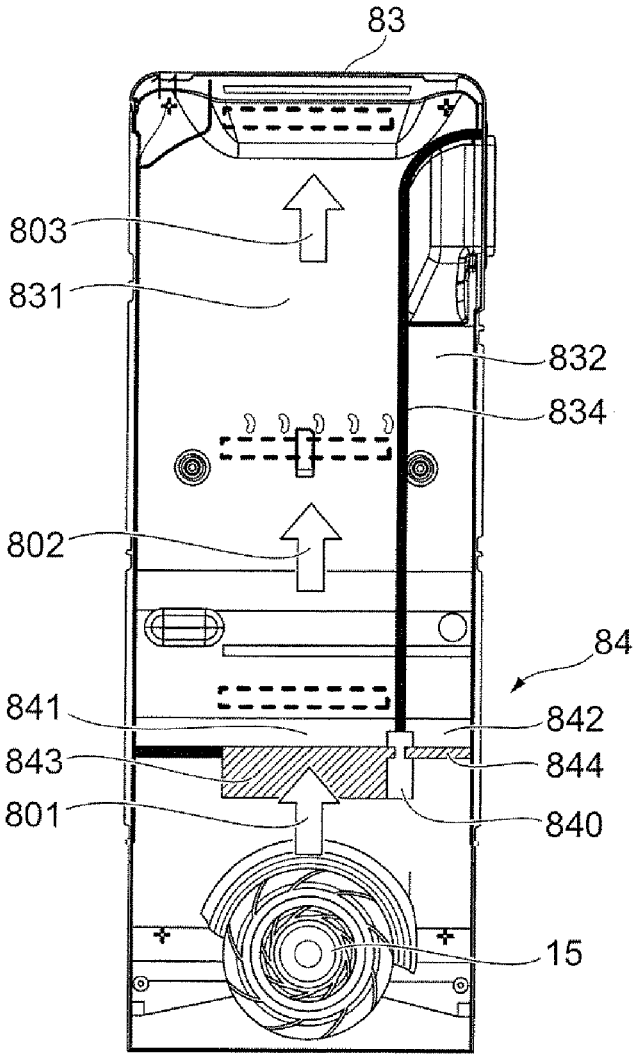
FIGS. 9A and 9B are views of a freezing compartment duct wall according to a second embodiment of the present disclosure viewed from a front side.
Figure 9B:
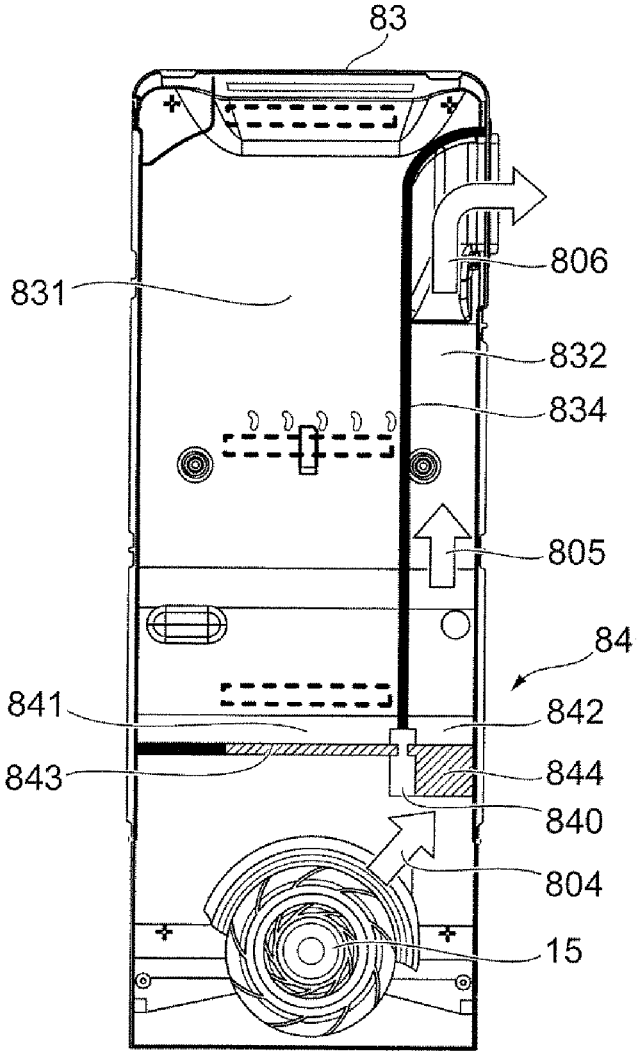

FIGS. 9A and 9B are views of the freezing compartment duct wall 83 according to the second embodiment of the present disclosure viewed from a front side.

As indicated by arrows 801, 802, and 803 in FIG. 9A, a passage for cooling a freezing compartment 831 is formed on the front left side of the freezing compartment duct wall 83 as an example of a first cold air passage used for cooling the freezing compartment 10. Further, as indicated by arrows 804, 805, and 806 in FIG. 9B, a passage for cooling a refrigerating compartment 832 is formed on the front right side of the freezing compartment duct wall 83 as an example of a second cold air passage used for cooling the refrigerating compartment 20.

Further, as shown in FIGS. 9A and 9B, the passage for cooling a freezing compartment 831 and passage for cooling a refrigerating compartment 832 are individually formed by the partition 834.

Further, the freezing compartment duct wall 83 is provided with a damper 84 as an example of a switching means for switching between the passage for cooling a freezing compartment 831 and passage for cooling a refrigerating compartment 832, and with a cooling fan 15 for blowing cold air.

Here, the damper 84 includes a driving unit 840, an opening for a passage for cooling a freezing compartment 841, an opening for a passage for cooling a refrigerating compartment 842, and opening and closing plates 843 and 844, and is configured such that the opening for the passage for cooling a freezing compartment 841 and the opening for the passage for cooling a refrigerating compartment 842 can be independently opened and closed.

For example, as shown in FIG. 9A, when the opening and closing plate 843 is laid down and the opening and closing plate 844 stands upright, the opening for the passage for cooling a freezing compartment 841 is open and the opening for the passage for cooling a refrigerating compartment 842 is closed. Further, as shown in FIG. 9B, when the opening and closing plate 843 stands upright and the opening and closing plate 844 is laid down, the opening for the passage for cooling a freezing compartment 841 is closed and the opening for the passage for cooling a refrigerating compartment 842 is open.

Furthermore, the passage for cooling a freezing compartment 831 and passage for cooling a refrigerating compartment 832 are formed to be included in a single passage on the same plane by using the damper 84. As a result, it is possible to reduce the thickness of the entire freezing compartment duct in the second embodiment.

Further, even in such a structure, since the passage for cooling a freezing compartment 831 and passage for cooling a refrigerating compartment 832 are reliably separated by the partition 834, a high humidity effect equivalent to that of the first embodiment can be attained.

Further, the operation for controlling humidity so that the inside of the refrigerating compartment 20 has high humidity, as described with reference to FIGS. 7 and 8 in the first embodiment, is also applicable to the second embodiment.

Third Embodiment

The refrigerator 1 according to the third embodiment of the present disclosure is the same as that described in the first embodiment except for the inside of the freezing compartment duct, and thus a description thereof will be omitted.

Figure 10A:
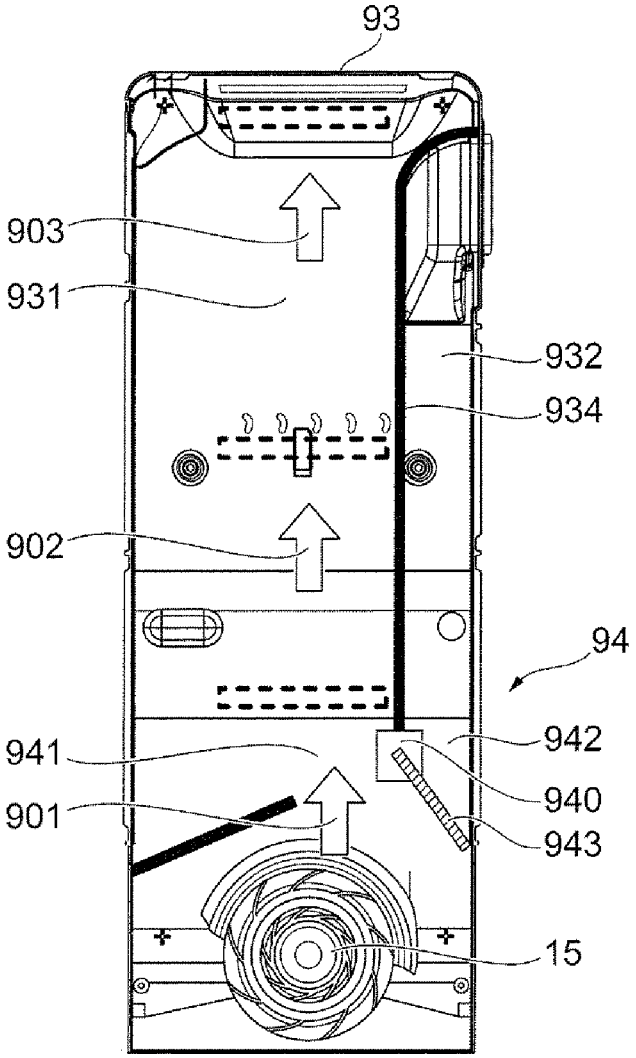
FIGS. 10A and 10B are views of a freezing compartment duct wall according to a third embodiment of the present disclosure viewed from a front side.
Figure 10B:
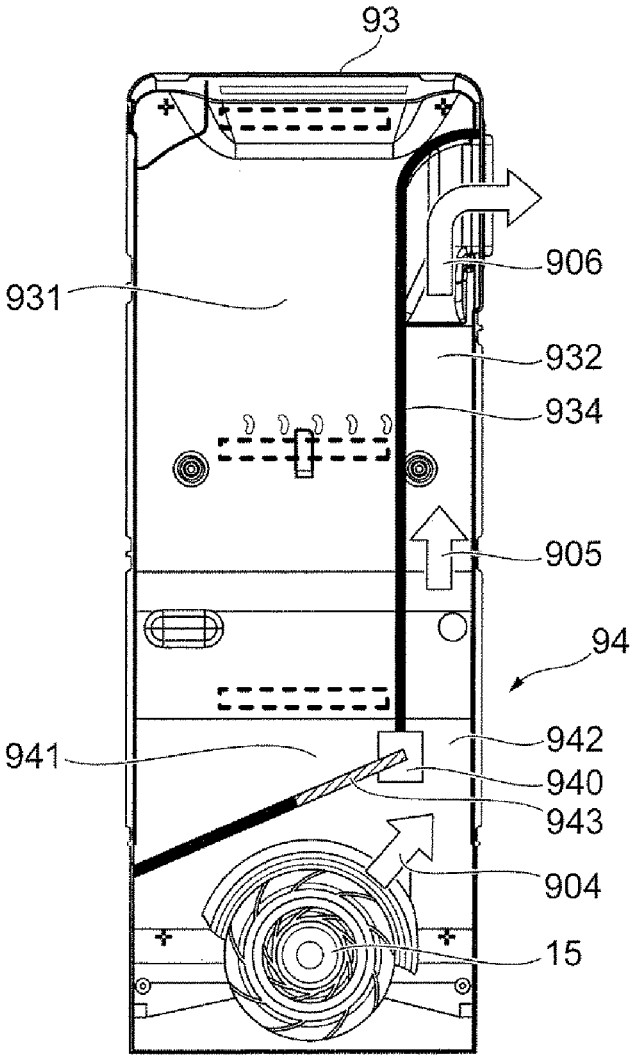

FIGS. 10A and 10B are views of the freezing compartment duct wall according to the third embodiment of the present disclosure viewed from a front side.

As indicated by arrows 901, 902, and 903 in FIG. 10A, a passage for cooling a freezing compartment 931 is formed on the front left side of the freezing compartment duct wall 93 as an example of a first cold air passage used for cooling the freezing compartment 10. Further, as indicated by arrows 904, 905, and 906 in FIG. 10B, a passage for cooling a refrigerating compartment 932 is formed on the front right side of the freezing compartment duct wall 93 as an example of a second cold air passage used for cooling the refrigerating compartment 20.

Further, as shown in FIGS. 10A and 10B, the passage for cooling a freezing compartment 931 and passage for cooling a refrigerating compartment 932 are individually formed by the partition 934.

Further, the freezing compartment duct wall 93 is provided with a damper 94 as an example of a switching means for switching between the passage for cooling a freezing compartment 931 and passage for cooling a refrigerating compartment 932, and with a cooling fan 15 for blowing cold air.

Here, the damper 94 includes a driving unit 940, an opening for a passage for cooling a freezing compartment 941, an opening for a passage for cooling a refrigerating compartment 942, and an opening and closing plate 943, and the opening and closing plate 943 is installed to rotate within a fan-shaped range of about 90° around the driving unit 940.

For example, as shown in FIG. 10A, when the opening and closing plate 943 is rotated to the rightmost side of the fan shape, the opening for the passage for cooling a freezing compartment 941 is open and the opening for passage for cooling a refrigerating compartment 942 is closed. Further, as shown in FIG. 10B, when the opening and closing plate 943 is rotated to the leftmost side of the fan shape, the opening for the passage for cooling a freezing compartment 941 is closed and the opening for the passage for cooling a refrigerating compartment 942 is open.

Furthermore, the same effects as those of the second embodiment can be obtained, and a high humidity effect equivalent to that of the first embodiment can also be obtained by using the damper 94.

Further, the operation for controlling humidity so that the inside of the refrigerating compartment 20 has high humidity, as described with reference to FIGS. 7 and 8 in the first embodiment, is also applicable to the third embodiment.

Fourth Embodiment

In the first to third embodiments, any one passage of two systems for blowing cold air to each of the freezing compartment and refrigerating compartment is selected by switching control of a damper, but the present disclosure is not limited thereto. When any one passage of two systems may be selected, for example, a one-way valve having an opening and closing mechanism or a solenoid-type opening and closing valve may be provided for each passage, and the same effects as those of the first to third embodiments can be obtained using this structure.

Alternatively, in the first to third embodiments, one cooling fan 15 is provided, and cold air blown by the cooling fan 15 is sent to any one passage of two systems toward the freezing compartment and refrigerating compartment by switching control of the damper, but the present disclosure is not limited thereto. Two cooling fans may be provided and cold air may be sent to any one passage of two systems toward the freezing compartment and refrigerating compartment by on/off control of the cooling fans. Specifically, a fan for the freezing compartment corresponding to a passage toward the freezing compartment and a fan for the refrigerating compartment corresponding to a passage toward the refrigerating compartment may be provided, and when cold air is sent to only the passage toward the freezing compartment, the fan for the freezing compartment is turned on while the fan for the refrigerating compartment is turned off, and when cold air is sent only to the passage toward the refrigerating compartment, the fan for the freezing compartment is turned off while the fan for the refrigerating compartment is turned on. Further, the fan for the freezing compartment and the fan for the refrigerating compartment in this case are examples of a switching means.

As is apparent from the above description, a refrigerator according to the present disclosure reduces the possibility that the environment of the first storage compartment influences the second storage compartment when the first storage compartment and the second storage compartment have different temperature ranges and are cooled by a single cooler.

Specific embodiments of the present disclosure have been illustrated and described above. However, the present disclosure is not limited to the aforementioned specific exemplary embodiments, and those skilled in the art may variously modify the disclosure without departing from the gist of the disclosure claimed by the appended claims within the scope of the claims.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator, comprising:

a compressor configured to compress and circulate a refrigerant;

a cooler configured to generate cold air;

a first storage compartment having an internal temperature maintained within a first temperature range;

a second storage compartment having an internal temperature maintained within a second temperature range different from the first temperature range;

a first cold air passage configured to guide the cold air generated in the cooler to the first storage compartment;

a second cold air passage configured to guide the cold air generated in the cooler to the second storage compartment;

a partition configured to separate the first cold air passage from the second cold air passage, wherein the first cold air passage is partially defined by a first surface of the partition, the second cold air passage is partially defined by a second surface of the partition, and the first surface is opposite to the second surface on the partition;

a cooling fan configured to blow the cold air generated in the cooler; and a damper comprising:

a container located downwind from the cooling fan and comprising:

a first opening communicating with the first cold air passage, and a second opening communicating with the second cold air passage, and a plate configured to guide the cold air generated in the cooler by moving entirely within the container to selectively flow into at least one of the first cold air passage through the first opening or the second cold air passage through the second opening.

2. The refrigerator according to claim 1, wherein the first cold air passage and the second cold air passage share at least one side wall.

3. The refrigerator according to claim 1, wherein the second cold air passage is disposed at a position farther from the first storage compartment than the first cold air passage.

4. The refrigerator according to claim 1, wherein the first temperature range is lower than the second temperature range.

5. The refrigerator according to claim 1, further comprising a third cold air passage used as a return passage for returning cold air used for cooling the second storage compartment and configured to:

prevent the cold air from flowing from a cooler room accommodating the cooler to the second storage compartment when the cold air generated in the cooler is guided to the first cold air passage by the damper, and guide the cold air to flow from the second storage compartment to the cooler room when the cold air generated in the cooler is guided to the second cold air passage by the damper.

6. The refrigerator according to claim 1, further comprising a processor configured to:

control the damper such that the cold air blown by the cooling fan flows into the first cold air passage, stop the compressor, operate the cooling fan, and then control the damper in a manner that the cold air blown by the cooling fan flows into the second cold air passage.

7. The refrigerator according to claim 6, wherein the processor is further configured to control the damper in a manner that the cold air blown by the cooling fan flows into the second cold air passage when a temperature of the cooler reaches a predetermined temperature or a predetermined amount of time has elapsed.

8. The refrigerator according to claim 6, wherein the processor is further configured to:

control the damper in a manner that the cold air blown by the cooling fan flows into the second cold air passage, and then operate the compressor again when a temperature inside the second storage compartment or a temperature of the cooler is equal to or higher than a predetermined temperature, or when an amount of time used for cooling the second storage compartment is a predetermined amount of time.

9. The refrigerator according to claim 8, further comprising a variable expansion valve including at least two different diameters, wherein the processor is further configured to change a flow rate of the refrigerant by switching to a diameter of any one of the at least two different diameters when the compressor is operated.

10. The refrigerator according to claim 6, wherein the processor is further configured to:

control the damper in a manner that the cold air blown by the cooling fan flows into the second cold air passage, and then stop the cooling fan when a temperature inside the second storage compartment or a temperature of the cooler is equal to or higher than a predetermined temperature, or when an amount of time used for cooling the second storage compartment is a predetermined amount of time.

11. The refrigerator according to claim 10, wherein the processor is further configured to stop the cooling fan and restart the cooling fan when the temperature of the cooler reaches the predetermined temperature or when the predetermined amount of time has elapsed.

12. The refrigerator according to claim 6, wherein the processor is further configured to continue to operate the cooling fan even when a temperature inside the second storage compartment reaches a target temperature.

13. The refrigerator according to claim 12, wherein the processor is further configured to open a bypass path for directly guiding the refrigerant compressed by the compressor to the cooler while the cooling fan is being operated.

14. The refrigerator according to claim 13, wherein the processor is further configured to close the bypass path when the temperature inside the second storage compartment or a temperature of the cooler reaches a predetermined temperature.

15. The refrigerator according to claim 1, further comprising a processor configured to:

operate the cooling fan during a defrosting operation of the cooler, and control the damper in a manner that the cold air blown by the cooling fan flows into the second cold air passage.

16. The refrigerator according to claim 15, wherein the processor is further configured to stop the cooling fan when a temperature inside the second storage compartment or a temperature of the cooler reaches a predetermined temperature or when a predetermined amount of time has elapsed.

17. The refrigerator according to claim 1, wherein the plate includes:

a first plate for opening and closing the first opening, and a second plate for opening and closing the second opening.

18. The refrigerator according to claim 17, further comprising a driver configured to drive the first plate and the second plate.

* * * * *